US009241207B2

(12) United States Patent
Wang et al.

(10) Patent No.: US 9,241,207 B2
(45) Date of Patent: Jan. 19, 2016

(54) SPEAKER MODULE

(71) Applicant: GOERTEK INC., WeiFang (CN)

(72) Inventors: Jianjian Wang, Weifang (CN); Zhibing Zhang, Weifang (CN); Shuangshuang Fan, Weifang (CN); Minghui Shao, Weifang (CN); Zongjun Mou, Weifang (CN); Chao Xu, Weifang (CN); Gang Chen, Weifang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 14/422,632

(22) PCT Filed: Aug. 23, 2013

(86) PCT No.: PCT/CN2013/082205

§ 371 (c)(1),
(2) Date: Feb. 19, 2015

(87) PCT Pub. No.: WO2014/032550

PCT Pub. Date: Mar. 6, 2014

(65) Prior Publication Data

US 2015/0304747 A1 Oct. 22, 2015

(30) Foreign Application Priority Data

Aug. 25, 2012 (CN) ..... 2012 1 0304831

(51) Int. Cl.
*H04R 1/02* (2006.01)
*H04R 1/28* (2006.01)
*H04R 1/34* (2006.01)

(52) U.S. Cl.
CPC ..... *H04R 1/02* (2013.01); *H04R 1/2819* (2013.01); *H04R 1/2842* (2013.01); *H04R 1/347* (2013.01); *H04R 2205/022* (2013.01); *H04R 2205/024* (2013.01)

(58) Field of Classification Search
CPC ..... H04R 1/02; H04R 1/20; H04R 1/2815; H04R 1/2819; H04R 1/2834; H04R 1/2842; H04R 1/2849; H04R 1/2861; H04R 1/347; H04R 5/02; H04R 2205/022; H04R 2204/024
USPC ..... 381/300, 304, 305, 332, 334, 335, 337, 381/345, 349, 350, 351, 182, 186, 386; 181/144, 145, 147, 156, 199
See application file for complete search history.

(56) References Cited

U.S. PATENT DOCUMENTS 3,142,353 A * 7/1964 Todisco ..... H04R 1/2826 181/145
5,147,986 A * 9/1992 Cockrum ..... H04R 29/003 181/145

(Continued)

FOREIGN PATENT DOCUMENTS

CN 2342535 Y 10/1999
CN 101427588 A 5/2009

(Continued)

OTHER PUBLICATIONS

International Search Report for PCT/CN2013/082205 filed on Aug. 23, 2013.

*Primary Examiner* — Huyen D Le

(57) ABSTRACT

The present invention provides a speaker module comprising a peripheral frame and speaker units housed in the peripheral frame, and the peripheral frame is provided with sound holes in communication with the outside, a front acoustic cavity in communication with the sound holes is defined between one side of the speaker units and the peripheral frame, and a rear acoustic cavity is defined between the peripheral frame and another side of the speaker units away from the front acoustic cavity; in which the speaker units are provided in plurality, and the rear acoustic cavity is divided into the same number of rear sub-cavities as that of the speaker units, and each of the speaker units corresponds to one of the rear sub-cavities and is in communication with its corresponding rear sub-cavity. The above structure makes it easier to adjust the acoustic performance and improves the stereo effect of the product.

9 Claims, 3 Drawing Sheets

(56) References Cited

U.S. PATENT DOCUMENTS

| | | | | |
|---|---|---|---|---|
| 6,169,812 | B1 | 1/2001 | Miller | |
| 2009/0190784 | A1 * | 7/2009 | Ong | H04R 1/2819 381/351 |

FOREIGN PATENT DOCUMENTS

| | | | |
|---|---|---|---|
| CN | 101816189 | A | 8/2010 |
| CN | 102361501 | A | 2/2012 |
| CN | 102802100 | A | 11/2012 |

* cited by examiner

SPEAKER MODULE

TECHNICAL FIELD OF THE INVENTION

The present invention relates to the electro-acoustic field, and particularly to a speaker module.

BACKGROUND OF THE INVENTION

Nowadays, portable electronic product is gaining popularity, and the speaker, as one of the most important acoustic devices, is also applied in various fields. In the related art, in order to guarantee the acoustic characteristics and the convenience of assembly, the speaker is usually manufactured into a speaker module.

The speaker module comprises a peripheral frame and a speaker unit housed in the peripheral frame. The conventional speaker module comprises only one speaker unit, and for those speaker modules which have a complicated structure and a high requirement for acoustic performance, it is usually difficult to guarantee both the acoustic performance and the fully exploitation of the inner space of the peripheral frame. Therefore, in order to improve the overall performance of the speaker module, it is necessary to provide a solution to address the abovementioned drawbacks.

SUMMARY OF THE INVENTION

In order to address the above-mentioned technical problem, the present invention provides a speaker module which can fully utilize the inner space of the speaker module and improve the acoustic performance of the product.

The present invention provides a speaker module which comprises a peripheral frame and speaker units housed in the peripheral frame, and the peripheral frame is provided thereon with sound holes in communication with the outside, and a front acoustic cavity in communication with the sound holes is defined between one side of the speaker units and the peripheral frame, and a rear acoustic cavity is defined between the peripheral frame and another side of the speaker units which is away from the front acoustic cavity; wherein the speaker units are provided in plurality, and the rear acoustic cavity is divided into a plurality of rear sub-cavities which are in the same number with the number of the speaker units, and each of the speaker units corresponds to one of the rear sub-cavities, and each of the speaker units is communicated with its respective corresponding rear sub-cavity.

Preferably, two speaker units are provided which comprise a first speaker unit and a second speaker unit which are disposed parallel; a dividing wall is provided inside the rear acoustic cavity to divide the rear acoustic cavity into two separate rear sub-cavities which comprise a first rear sub-cavity and a second rear sub-cavity, in which the first speaker unit is in communication with the first rear sub-cavity and the second speaker unit is in communication with the second rear sub-cavity.

Preferably, the peripheral frame includes a first housing and a second housing, and the rear acoustic cavity is defined by the space between the first housing, the second housing and the speaker units; the second housing is provided with a first sub-wall as a first part of the dividing wall which first sub-wall divides the inner space of the second housing into the first rear sub-cavity corresponding to the first speaker unit and the second rear sub-cavity corresponding to the second speaker unit.

Preferably, the first housing is provided with a second sub-wall as a second part of the dividing wall corresponding to the first sub-wall as the first part of the dividing wall, and the second sub-wall and the first sub-wall are bonded through ultrasonic welding.

Preferably, each of the first speaker unit and the second speaker unit comprises a vibrating system and a magnetic circuit system, the vibrating system includes a vibrating diaphragm, the front acoustic cavity is located on one side of the vibrating diaphragm away from the magnetic circuit system, and the rear acoustic cavity is located on another side of the vibrating diaphragm close to the magnetic circuit system.

Preferably, the front acoustic cavity is provided with a partition wall which divides the front acoustic cavity into separate first and second front sub-cavities, in which the first front sub-cavity is provided correspondingly to the first speaker unit and the second front sub-cavity is provided correspondingly to the second speaker unit.

Preferably, the speaker module is provided with sound holes disposed on the lateral side of the peripheral frame, and the sound holes disposed on the lateral side include a first sound hole in communication with the first front sub-cavity and a second sound hole in communication with the second front sub-cavity.

Preferably, the vibrating system and the magnetic circuit system of the first and second speaker units are in the same structure.

Preferably, the first front sub-cavity has the same size as that of the second front sub-cavity.

The speaker module in the present invention is designed with a plurality of speaker units, and the rear acoustic cavity is divided into a plurality of rear sub-cavities with each of them corresponding to one of the speaker units, which makes it easier to adjust the acoustic performance of the speaker module, improving the stereophonic effect thus improving the overall acoustic performance of the product.

BRIEF DESCRIPTION OF THE DRAWINGS

The above mentioned features and technical advantages of the present invention will become more apparent and be understood readily from the following description of the embodiments in conjunction with the drawings.

DETAILED DESCRIPTION OF EMBODIMENTS OF THE INVENTION

The present invention will be detailed below in conjunction with the drawings and specific embodiments.

Figure 1:
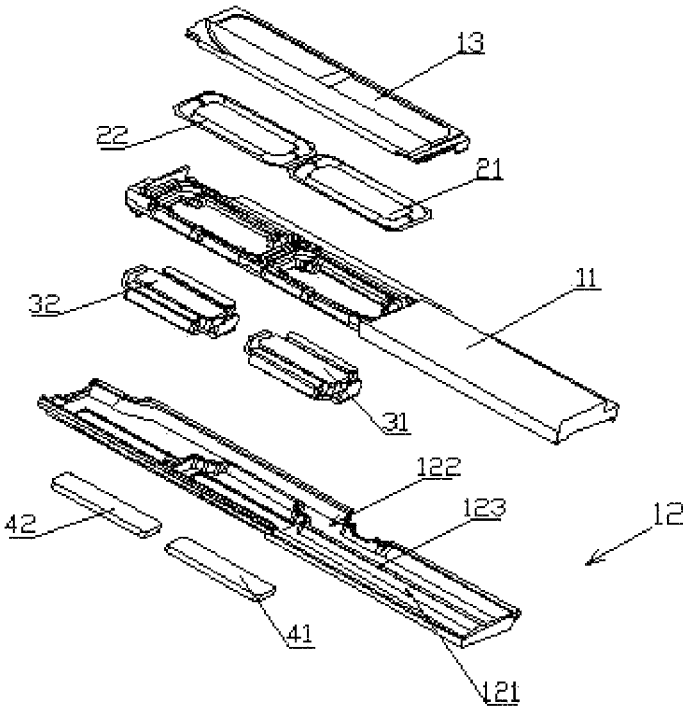
FIG. 1 is a schematic diagram of the perspective exploded structure of a speaker module of the present invention.

As shown in FIG. 1, the speaker module comprises a peripheral frame and speaker units housed in the peripheral frame, the speaker unit comprising a vibrating system and a magnetic circuit system. The present invention comprises two parallel speaker units of a first speaker unit and a second speaker unit, the first speaker unit comprises a vibrating system 21 and a magnetic circuit system 31, and the second speaker unit comprises a vibrating system 22 and a magnetic circuit system 32. Each of the vibrating system 21 and the vibrating system 22 comprises a vibrating diaphragm and a voice coil coupled to the lower side of the vibrating diaphragm (the voice coil is not shown in the perspective of FIG. 1), and the vibrating system comprises a washer, a magnet and a basket which are bonded sequentially.

This type of speaker module comprising two speaker units can fully utilize its inner space. Preferably, the first and second speaker units have the same structure, and the vibrating system and the magnetic circuit system of the both speaker units are in the same structure, and the corresponding parts of the same structures have the same size, thus improving the acoustic performance of the speaker module.

The peripheral frame of the present invention comprises a first housing 11, a second housing 12 and an insert 13, wherein each of the first housing 11 and the second housing 12 is provided with a structure housing and fixing the vibrating system and the magnet circuit system, as shown in FIG. 1. The insert 13 comprises a metal plate and a plastic frame disposed around the metal plate. This structure of the plastic frame disposed around the metal plate can allow the speaker module to reduce its thickness while still achieving the desired strength. Further, a metal heat sink 41 and a metal heat sink 42 are included which are bonded with the second housing 12 and disposed at the bottom of the magnetic circuit system. The two metal heat sinks have the same structure and function respectively for the first and second speaker units. Preferably, the metal heat sink 41 and the metal heat sink 42 are magnetic permeable structures. The design of the metal heat sinks can have the effect of heat sink while fully exploiting the inner space of the speaker module and avoiding the magnetic saturation.

Figure 2:
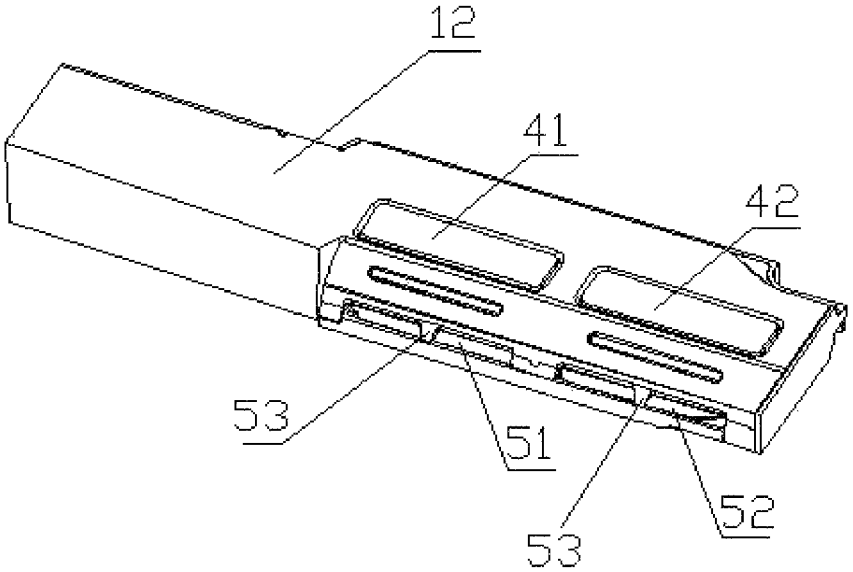
FIG. 2 is a schematic diagram of the perspective structure of a speaker module of the present invention.
Figure 3:
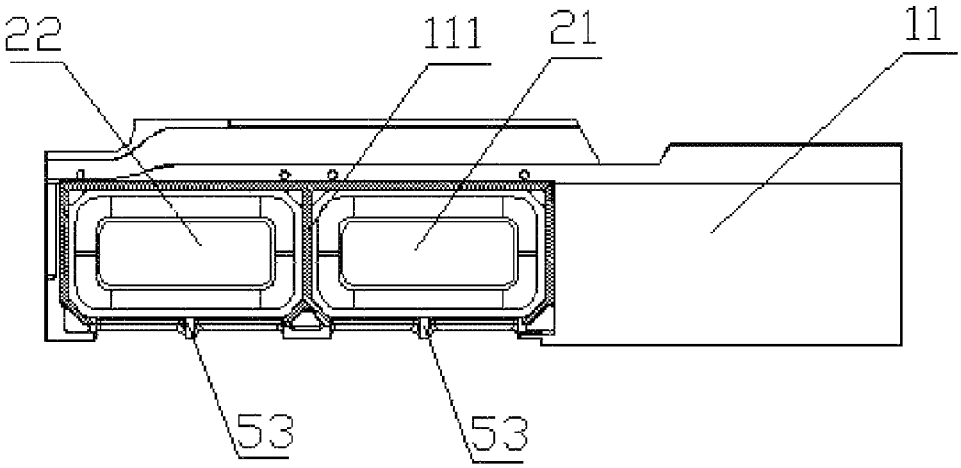
FIG. 3 is a schematic diagram of the structure of the speaker module of the present invention after removing an insert.

As shown in FIGS. 2 and 3, the present invention is a speaker module which makes sound from the lateral side, including a first sound hole 51 and a second sound hole 52, wherein the first sound hole 51 and the second sound hole 52 are structures spaced apart which make sound separately. A front acoustic cavity is formed between each of the speaker units and the peripheral frame, and in the present embodiment, the front acoustic cavity is formed in the space between the vibrating diaphragm of the speaker unit, the first housing 11 and the insert 13. Usually, the front acoustic cavity is a channel connecting the speaker unit and the outside, and the sound generated by the speaker unit is transmitted to the outside through the front acoustic cavity. As shown in FIG. 3, at a position on the first housing 11 in the middle of the first vibrating system 21 and the second vibrating system 22 is arranged a partition wall 111, which can divide the front acoustic cavity into separate first and second front sub-cavities, that is a first front sub-cavity corresponding to the first speaker unit and a second front sub-cavity corresponding to the second speaker unit.

Further, the first sound hole 51 is in communication with the first front sub-cavity, and the second sound hole 52 is in communication with the second front sub-cavity, so as to separate the sounds generated by the first speaker unit and the second speaker unit from each other, thus capable of preventing the sound waves of the two speaker units from interfering with each other. Preferably, the first and second front sub-cavities have the same or similar sizes, thus capable of guaranteeing consistency of the sounding of the two speaker units.

Further, the first and second sound holes 51 and 52 are also provided with the supporting protrusions 53 which can increase the strength on the peripheral frame around the sound holes thus improving the stability of the structure of the product.

Figure 4:
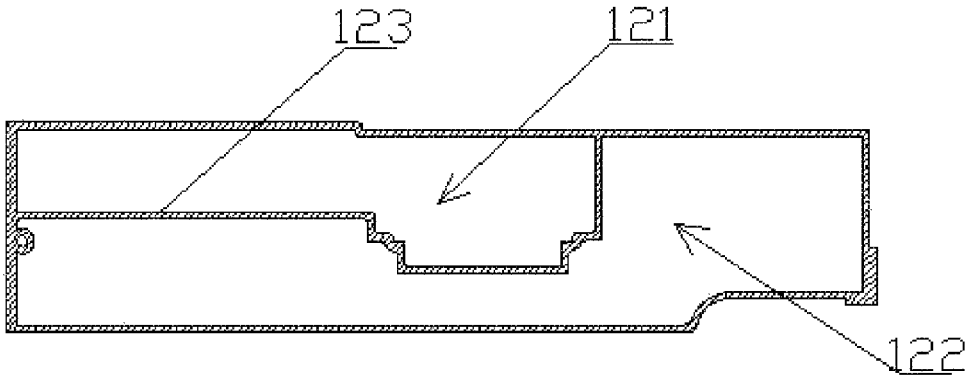
FIG. 4 is a schematic diagram of the structure of the second housing of the speaker module of the present invention.
Figure 5:
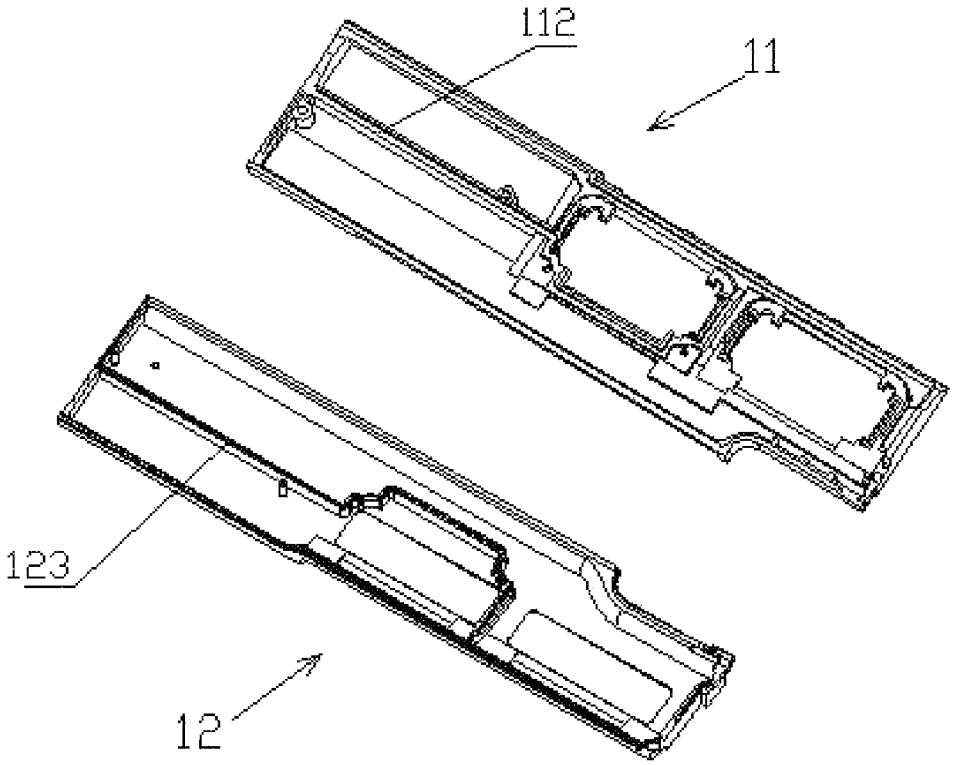
FIG. 5 is a schematic diagram of the assembly structure of the first housing and the second housing of the speaker module of the present invention.

A rear acoustic cavity is formed between the first housing 11, the second housing 12 and the speaker units. The rear acoustic cavity is a space formed on the side of the vibrating diaphragm of the speaker units close to the voice coil (i.e., the side of the vibrating diaphragm away from the front acoustic cavity). The rear acoustic cavity is a closed structure to seal the space on the rear side of the vibrating diaphragm (the side of the vibrating diaphragm close to the voice coil). The rear acoustic cavity can be divided into a plurality of rear sub-cavities. As shown in FIG. 1, FIG. 4 and FIG. 5, the second housing 12 is provided with two rear sub-cavities corresponding to the first speaker unit and the second speaker unit, respectively, i.e., a first rear sub-cavity 121 and a second rear sub-cavity 122 which are separated from each other by a first sub-wall 123 which is formed integrally with the second housing 12. Preferably, the first and second rear sub-cavities 121 and 122 have the same or similar sizes to guarantee consistency of sounding of product. Further, a second sub-wall 112 corresponding to the first sub-wall 123 is arranged on the side of the first housing 11 facing the second housing 12. After completion of assembling, the first sub-wall 123 and the second sub-wall 112 are bonded with each other through ultrasonic welding, so that the first rear sub-cavity 121 and the second rear sub-cavity 122 are separated from each other completely, forming the sealed first and second rear sub-cavities which are in communication with the first speaker unit and the second speaker unit, respectively.

Compared with the speaker module including only one speaker unit, the speaker module including two speaker units has the advantage of being easier to adjust, and especially for the slim type module, the inclusion of two speaker units can avoid the problem such as the unbalance of vibration. Besides, each of the speaker units can have its own rear sub-cavity thus avoiding the interference between the two speaker units, which makes it easier to adjust the acoustic characteristics of the speaker module, and improves the stereo effect of the speaker module and the acoustic performance of the product.

It should be noted that, the number of the speaker units is not limited to two, and can be more than two. The rear acoustic cavity is divided into the same number of rear sub-cavities as that of the speaker units, and each of the speaker units corresponds to one independent rear sub-cavity. The modification of the number of the speaker units and the rear sub-cavities is also included in the protective scope of the present invention.

Those skilled in the art can make modifications and variations to the above mentioned embodiments without departing from the spirit of the present invention which should be included in the protective scope of the present invention. It should be understood for those skilled in the art that the descriptions for the embodiments are only used for explaining the present invention, and the protection scope of the present invention should be only defined by the claims and their equivalents.

What is claimed is:

1. A speaker module, which comprises a peripheral frame and speaker units housed in the peripheral frame, wherein, the peripheral frame is provided thereon with sound holes in communication with the outside, and a front acoustic cavity in communication with the sound holes is defined between one side of the speaker units and the peripheral frame, and a rear acoustic cavity is defined between the peripheral frame and the other side of the speaker units which is away from the front acoustic cavity; wherein the speaker units are provided in plurality, and the rear acoustic cavity is divided into a plurality of rear sub-cavities which are in the same number with the number of the speaker units, and each of the speaker units corresponds to one of the rear sub-cavities, and each of the speaker units is communicated with its respective corresponding rear sub-cavity.

2. The speaker module of claim 1, wherein two speaker units are provided which comprise a first speaker unit and a second speaker unit which are disposed parallel; a dividing wall is provided inside the rear acoustic cavity to divide the rear acoustic cavity into two separate rear sub-cavities which comprise a first rear sub-cavity and a second rear sub-cavity, in which the first speaker unit is in communication with the first rear sub-cavity and the second speaker unit is in communication with the second rear sub-cavity.

3. The speaker module of claim 2, wherein the peripheral frame includes a first housing and a second housing, and the rear acoustic cavity is defined by the space between the first housing, the second housing and the speaker units; the second housing is provided with a first sub-wall which divides the inner space of the second housing into the first rear sub-cavity corresponding to the first speaker unit and the second rear sub-cavity corresponding to the second speaker unit.

4. The speaker module of claim 3, wherein the first housing is provided with a second sub-wall corresponding to the first sub-wall, and the second sub-wall and the first sub-wall are bonded through ultrasonic welding.

5. The speaker module of claim 2, wherein each of the first speaker unit and the second speaker unit comprises a vibrating system and a magnetic circuit system, the vibrating system includes a vibrating diaphragm, the front acoustic cavity is located on one side of the vibrating diaphragm away from the magnetic circuit system, and the rear acoustic cavity is located on another side of the vibrating diaphragm close to the magnetic circuit system.

6. The speaker module of claim 5, wherein the front acoustic cavity is provided with a partition wall which divides the front acoustic cavity into separate first and second front sub-cavities, in which the first front sub-cavity is provided correspondingly to the first speaker unit and the second front sub-cavity is provided correspondingly to the second speaker unit.

7. The speaker module of claim 6, wherein the sound holes are disposed on the lateral side of the peripheral frame, and the sound holes include a first sound hole in communication with the first front sub-cavity and a second sound hole in communication with the second front sub-cavity, wherein the first sound hole and the second sound hole are spaced apart.

8. The speaker module of claim 6, wherein the first front sub-cavity has the same size as that of the second front sub-cavity.

9. The speaker module of claim 5, wherein the first speaker unit and the second speaker unit are identical, and the vibrating system and the magnetic circuit system of the both speaker units are in the same structure.

* * * * *